United States Patent [19]

Cowan

[11] 4,269,268

[45] May 26, 1981

[54] HANGER APPARATUS FOR SUSPENDING PIPES WITH POSITIVE RETRIEVAL CAPABILITY

[75] Inventor: William S. Cowan, West University Place, Tex.

[73] Assignee: Armco Inc., Middletown, Ohio

[21] Appl. No.: 76,185

[22] Filed: Sep. 17, 1979

Related U.S. Application Data

[63] Continuation-in-part of Ser. No. 915,829, Jun. 16, 1978, Pat. No. 4,167,970, and Ser. No. 915,830, Jun. 16, 1978, Pat. No. 4,167,971, and Ser. No. 915,902, Jun. 16, 1978, Pat. No. 4,181,331.

[51] Int. Cl.[3] ..... E21B 43/10; E21B 23/00

[52] U.S. Cl. ..... 166/208; 166/214; 285/141

[58] Field of Search ..... 166/115, 208, 214, 217; 285/141, 307

[56] References Cited

U.S. PATENT DOCUMENTS

| | | | |
|---|---|---|---|
| 3,227,218 | 1/1966 | Fisher, Jr. et al. | 166/216 |
| 3,420,308 | 1/1969 | Putch | 166/208 |
| 3,472,530 | 10/1969 | Fowler | 285/3 |
| 3,625,283 | 12/1971 | Ahlstone | 166/87 |
| 3,736,984 | 6/1973 | Garrett | 166/208 |
| 3,800,869 | 4/1974 | Herd et al. | 166/315 |
| 3,893,717 | 7/1975 | Nelson | 166/208 |
| 3,918,747 | 11/1975 | Putch | 166/208 |
| 3,944,273 | 3/1976 | Ahlstone | 294/86.1 |

FOREIGN PATENT DOCUMENTS

| | | | |
|---|---|---|---|
| 1159987 | 7/1958 | France | 285/148 |

*Primary Examiner*—James A. Leppink

*Attorney, Agent, or Firm*—Roylance, Abrams, Berdo & Farley

[57] ABSTRACT

A hanger apparatus for suspending an upright inner pipe from an outer pipe including a hanger body carried by the outer pipe, a hanger mandrel carried by the inner pipe, and a split locking ring carried in a recess in the hanger mandrel, the hanger body having a groove for receiving a rib on the locking ring and the hanger mandrel having a load-bearing shoulder received on a corresponding shoulder on the locking ring. The locking ring has a thick main body portion and a thin, flexible skirt depending therefrom. A rib on the hanger mandrel has an upwardly facing lifting surface for contacting a downwardly facing lifting surface formed as an upper wall in a transverse groove in the locking ring main body portion to provide a positive engagement during retrieval of the inner pipe. A guard rib below the lifting rib is releasably coupled to the hanger mandrel so the locking ring can be slipped into the mandrel with a minimum of distortion.

16 Claims, 6 Drawing Figures

HANGER APPARATUS FOR SUSPENDING PIPES WITH POSITIVE RETRIEVAL CAPABILITY

CROSS REFERENCES TO RELATED APPLICATIONS

This application is a continuation-in-part of the following three copending applications filed in the name of the inventor herein: application Ser. No. 915,829, filed June 16, 1978, now U.S. Pat. No. 4,167,970; application Ser. No. 915,830, filed June 16, 1978, now U.S. Pat. No. 4,167,971; and application Ser. No. 915,902, filed June 16, 1978, now U.S. Pat. No. 4,181,331.

FIELD OF THE INVENTION

Hanger apparatus for suspending pipes, such as a casing string, in an outer member, such as an outer casing string or well head member. The apparatus includes an expansible and contractable locking ring to support the inner pipes on the outer member and coacting lifting means on an inner pipe and the locking ring for positively lifting the locking ring out of engagement without undue deterioriation of the locking ring during retrieval of the inner pipes.

BACKGROUND OF THE INVENTION

It has long been a common practice in the well art to suspend an inner pipe, typically a casing string, concentrically within an outer member, typically an outer casing string or a wellhead member, by means of a hanger comprising a hanger member connected to the inner pipe and having a downwardly directed shoulder which engages an upwardly directed shoulder on the outer member as the inner pipe is run in. As the art developed, it became necessary to minimize the annular space between the inner and outer hanger members, and prior art workers have developed hangers employing a retractable hanger device carried by a mandrel on the inner pipe and capable of expanding into engagement with an outer hanger member when, as the inner pipe is run in, the mandrel reaches the outer hanger member. Pipe hangers of this type have become particularly important with the advent of offshore practices in which the hanger is located at the mudline and the outer pipe above the wellhead is of the same diameter as the outer casing below the wellhead and the annular space available for the hanger is relatively small. Such hangers are disclosed, for example, in the following U.S. patents: Nos.

| | |
|---|---|
| 3,420,308 | Putch |
| 3,472,530 | Fowler |
| 3,741,589 | Herd et al |
| 3,893,717 | Nelson |

Though hangers of this general type have achieved considerable success, they still present problems which increase in severity as the annular space available at the hanger decreases and the weight of the pipe string to be supported increases. Thus, it has been difficult to assure that the retractable hanger device, which must retract radially as the mandrel passes into the outer hanger member, will expand into proper engagement with the outer hanger member. Further, with the outer hanger member provided with grooves to accommodate the retractable hanger device, engagement between the outer member and the retractable device has not been adequate to assure that the large tension loads applied by the inner pipe string are adequately supported. Both problem areas tend to require structures which are unduly large in radial directions, unduly complex and excessively expensive.

These problem areas have been addressed by the inventions set forth in the above-identified applications in which, among other things, a split locking ring is utilized which has a relatively thick main body portion and a thinner, flexible skirt depending therefrom, the relatively thick main body having a locking rib and a catching rib received in respective grooves in the outer hanger member. While provision of a thin, flexible skirt on the locking ring is advantageous, thinness and flexibility of the skirt raises the problem that, as the locking ring is run down to the outer hanger member, the skirt might catch on a shoulder, a seal or some other discontinuity in the wall of the bore through which the locking ring must travel. Should the locking ring catch on a discontinuity in the bore, the thin wall of the skirt might be bent outwardly, ruining the locking ring and, e.g., damaging seals and the like in the bore. This problem is worsened by the fact that, once landed on the outer hanger member, the combination of the inner member and locking ring must be capable of being retrieved simply by pulling upwardly on the string of pipe being suspended. The desirable thinness and flexibility of the skirt of the locking ring increases the possibility that the skirt may be deformed unduly during such retrieval. Thus, despite the advantages offered by the inventions in the above-identified applications, there has been a continuing need for improvement.

OBJECTS OF THE INVENTION

A general object of the invention is to provide an improved hanger apparatus of the type described, wherein the dependent skirt of the locking ring can be made thinner and more flexible but the danger that the skirt might be unduly deformed during running in and retrieval is minimized.

Another object of the invention is to provide such a locking ring with a more positive retrieval capability.

A further object of the invention is to provide a guarding mechanism for the locking ring during downward movement, but which will not result in undue distortion during assembly of the locking ring on its hanger mandrel.

SUMMARY OF THE INVENTION

Broadly considered, hanger apparatus according to the invention comprise an outer hanger body having an inwardly opening locking groove, an inner hanger member or mandrel to be secured to the pipe to be supported and having an axially elongated transverse annular recess which opens outwardly into the annulus between the mandrel and the outer hanger body, there being a transverse annular downwardly facing support surface at the upper end of the recess; and generally annular lock means disposed in the recess, the annular lock means being resiliently deformable radially and having an outer configuration presenting an outwardly directed locking rib, capable of mating with the locking groove in the outer hanger body, and a transverse annular upwardly directed support shoulder capable of mating with the support surface at the upper end of the mandrel recess, the annular lock means being axially shorter than the mandrel recess and having both a main body portion, which carries the locking rib, and a flexible skirt depending from the body portion, the mandrel having an upwardly directed lifting surface located in the recess and disposed to oppose a downwardly directed lifting surface provided on the main body portion of the lock means, the arrangement thus assuring that, after the mandrel and lock means have been landed in the outer hanger body, application of an upward strain to retrieve the mandrel and lock means will cause the upwardly directed lifting surface of the mandrel to engage the downwardly directed lifting surface of the main body portion of the lock means, so that the main retrieval forces are applied directly to the relatively heavy main body portion of the lock means and not to the skirt. Advantageously, the upwardly facing lifting surface is provided on a lifting rib on the hanger mandrel and the downwardly facing lifting surface is provided as the top wall of a transverse inwardly opening groove in the locking ring. Thus, the upward force exerted on the locking ring for retrieval purposes is positively applied to the thicker part of the ring, not the thinner flexible skirt. In addition, a guard rib is threadedly coupled to the mandrel below the locking ring to protect the ring, but allow minimum outward distortion during assembly of the ring and the mandrel.

BRIEF DESCRIPTION OF THE DRAWINGS

In order that the manner in which the foregoing and other objects are achieved according to the invention can be understood in detail, one particularly advantageous embodiment of the invention will be described with reference to the accompanying drawings, which form part of the original disclosure of this application, and wherein.

DETAILED DESCRIPTION OF THE INVENTION

Figure 1:
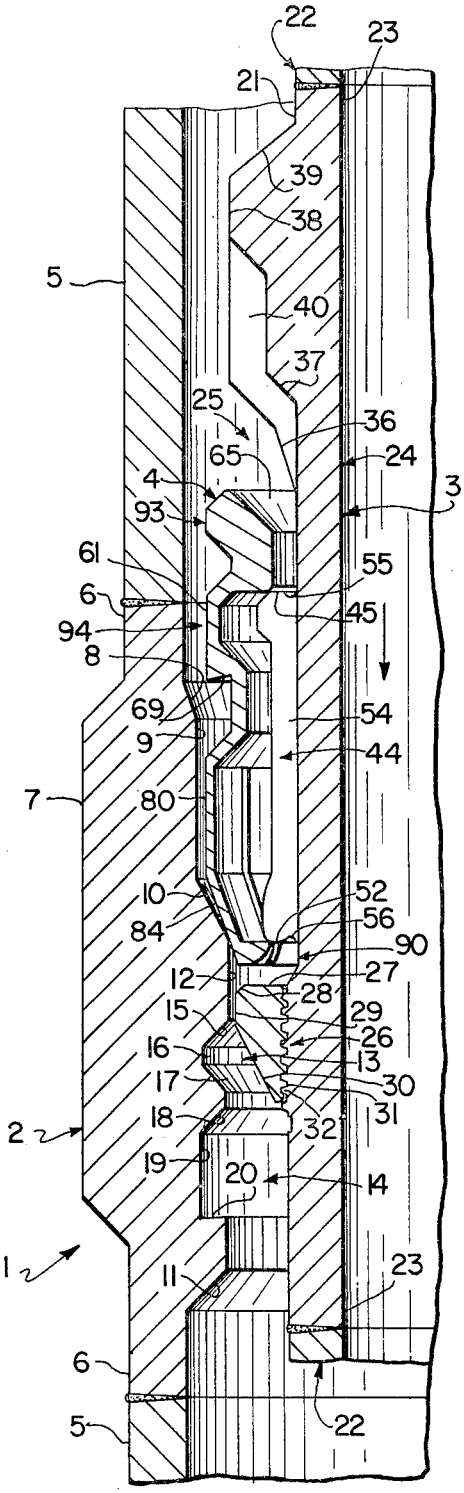
FIG. 1 is a fragmentary longitudinal sectional view of a hanger apparatus constructed according to one embodiment of the invention, illustrating the parts of the apparatus in the relative positions occupied as the lock means enters the outer hanger body.

Referring first to FIG. 1, the hanger apparatus 1 includes an outer hanger body 2, a hanger mandrel 3 and a locking ring 4. In this embodiment, hanger body 2 is carried by an outer pipe 5, such as a string of casing, and the hanger body is tubular. End portions 6 of hanger body 2 are right cylindrical and have the same wall thickness as the pipe 5, each end portion being secured, as by welding or threaded engagement, to the end of a different joint of the casing string. An intermediate portion 7 of hanger body 2, which extends for most of the length of that body, is substantially thicker than end portions 6 and projects inwardly, being bounded at its upper end by a frusto-conical surface 8 which tapers downwardly and inwardly to join the right cylindrical surface 9 of portion 7. From surface 9 there extends an inwardly and downwardly directed frusto-conical camming surface 10. The lower end of intermediate portion 7 is defined by an upwardly and inwardly tapering frusto-conical surface 11. Between surfaces 10 and 11 is a right cylindrical inner surface 12.

Inner surface 12 of portion 7 is interrupted by an upper transverse annular inwardly opening groove 13 and, spaced therebelow, a lower transverse annular inwardly opening groove 14. Upper groove 13 serves as a locking groove and is defined by a frusto-conical upper wall 15, which tapers downwardly and outwardly, a right cylindrical bottom wall 16, concentric with the longitudinal axis of pipe 5, and a frusto-conical load-bearing lower wall or shoulder 17 which tapers downwardly and inwardly. Lower groove 14 serves as a catching groove and has a frusto-conical downwardly and outwardly tapering upper wall 18, a right cylindrical bottom wall 19, concentric with the longitudinal axis of pipe 5, and a lower catching shoulder 20 which is frusto-conical and tapers upwardly and inwardly at a small angle, advantageously about 5°. Walls 15, 17 and 18 are advantageously each disposed at an angle of 45° relative to the pipe axis.

Figure 5:
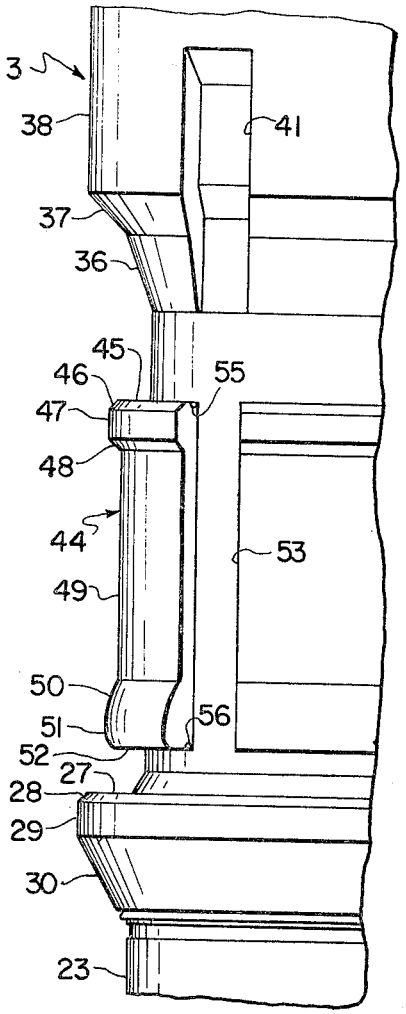
FIG. 5 is a fragmentary elevational view showing the outer surface of the hanger mandrel employed in the apparatus of FIG. 1.

Hanger mandrel 3, as seen in FIGS. 1 and 5, is an integral body having a right cylindrical outer surface 21 equal in diameter to the outer surface of the inner pipe 22 to be suspended, typically a casing string. End portions 23 of the mandrel are of substantially the same wall thickness as the inner pipe 22 and are rigidly secured thereto, as by welding or threaded engagement. An intermediate portion 24 of mandrel 3 has a right cylindrical inner surface which extends for the length of the mandrel. Portion 24 of the mandrel is provided with an outwardly opening recess 25 which extends longitudinally for most of the length of intermediate portion 24.

The lower end of recess 25 is defined by a transverse annular guard rib 26 which has a top surface 27 facing upwardly and lying in a plane at right angles to the longitudinal axis of the mandrel. Extending downwardly and outwardly from surface 27 is a frusto-conical surface 28 which has a right cylindrical surface 29 extending downward therefrom. An inwardly and downwardly tapering frusto-conical surface 30 extends from surface 29. Guard rib 26 has internal threads 31 releasably coupling the rib to the mandrel by means of corresponding threads 32 on the mandrel.

The upper end of recess 25 is defined by an outwardly and upwardly directed frusto-conical surface 36 and a second upwardly and outwardly directed frusto-conical end surface 37 which is a load-bearing shoulder. This shoulder 37 is at an angle of 45° to the pipe axis so as to be parallel to load-bearing shoulder 17 of groove 13 when the mandrel and hanger body are in the landed position shown in FIG. 2. From shoulder 37 a cylindrical surface 38 extends upwardly into an inwardly and upwardly directed frusto-conical surface 39 which extends into the cylindrical outer surface 21 of the hanger mandrel 3.

A series of vertical slots are provided in the mandrel 3, each beginning below surface 39 and extending through surface 36. There can be from four to eight slots provided, slots 40 and 41 being shown in FIGS. 1 and 5. These slots allow fluid, such as unset concrete, to flow past the otherwise substantially solid connection provided by the locking ring between the hanger mandrel 3 and the outer pipe 5.

Located in recess 25, spaced below surface 36 and above guard rib 26, is a lifting rib 44, seen in FIGS. 1 and 5. At the top of rib 44 is an annular lifting surface 45 lying in a plane perpendicular to the longitudinal axis of the hanger mandrel 3 and locking ring 4. Extending downwardly and outwardly from lifting surface 45 is a frusto-conical surface 46 which has a cylindrical surface 46 extending downwardly therefrom. From surface 46 extends an inwardly and downwardly directed frusto-conical surface 48, from which extends another cylindrical surface 49. An outwardly and downwardly directed frusto-conical surface 50 extends from the bottom of surface 49 into a curvilinear surface 51. This curvilinear surface 51 extends into a bottom annular surface 52 at the bottom of the rib 44, which lies in a plane parallel to the plane containing surface 45.

A series of vertical slots are provided in rib 44, which are aligned with the other previously described slots in the mandrel and are for the same purpose. These slots extend completely through the rib 44 from the lifting surface 45 to the bottom surface 52. Two that are shown are numbered 53 and 54.

To aid in eliminating fillets between surfaces 45 and 52 and the main part of the mandrel 3, small semi-cylindrical annular grooves 55 and 56 are provided at the respective intersections thereof, as seen in FIG. 1.

Figure 6:
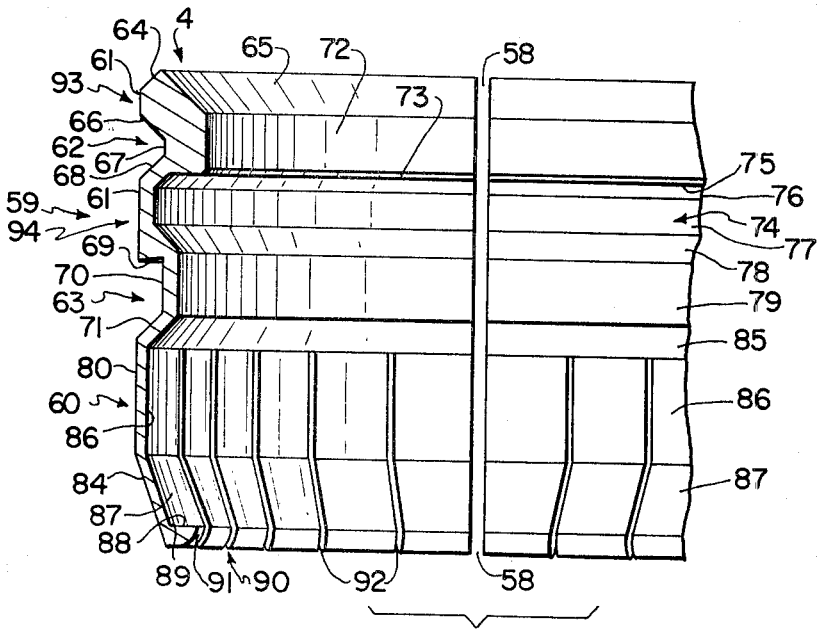
FIG. 6 is a fragmentary longitudinal sectional view showing the inner surface of the locking ring employed in the apparatus.

Shown in detail in FIG. 6, locking ring 4 is an integral resilient metal ring split longitudinally throughout its full length at 58. Ring 4 comprises an upper annular main body portion 59 and a flexible skirt 60, main body portion 59 being thick in comparison with the skirt, and the skirt depending from the main body portion. Main body portion 59 has a right cylindrical outer surface 61 interrupted by transverse annular outwardly opening grooves 62 and 63. The upper end of body portion 59 is defined by converging frusto-conical shoulders 64 and 65, shoulder 64 tapering from outer surface 61 upwardly and inwardly at 45° to the longitudinal axis of the ring, and shoulder 65 tapering downwardly and inwardly at 45° to the axis of the ring.

Groove 62 is defined by an upper frusto-conical wall or shoulder 66 which tapers downwardly and inwardly so as to be parallel with shoulder 65, a right cylindrical bottom wall 67, and a lower frusto-conical wall 68 which tapers upwardly and inwardly. Groove 63 is defined by a frusto-conical upper wall 69 or shoulder which tapers upwardly and inwardly at the same small angle as does catching shoulder 20 of hanger body 2, a right cylindrical bottom wall 70, and a frusto-conical lower wall 71 which tapers upwardly and inwardly at 45°.

The main body portion 59 has depending from shoulder 65 a cylindrical surface 72 which has an outwardly and downwardly directed frusto-conical surface 73 at the bottom. Below surface 73 is a lifting groove 74 defined by an upper annular wall 75 forming a lifting surface, an outwardly and downwardly directed frusto-conical wall 76 extending from wall 75, a bottom cylindrical wall 77, and a lower inwardly and downwardly directed frusto-conical wall 78. Lifting surface 75 lies in a plane perpendicular to the axis of locking ring 4.

From wall 78 extends a cylindrical wall 79, which has a diameter greater than the diameter of cylindrical surface 72.

Skirt is markedly thinner, and therefore markedly more flexible, than is body portion 59. The outer surface of the skirt is defined by the lower wall 71 of groove 63, a right cylindrical outer surface portion 80, and a downwardly and inwardly tapering frusto-conical camming surface 84. The inner surface of skirt 60 is defined by an upwardly and inwardly tapering frusto-conical surface portion 85, a right cylindrical inner surface portion 86, a downwardly and inwardly tapering frusto-conical surface portion 87 and a downwardly and inwardly tapering frusto-conical surface 88 extending from portion 87 with a small radius bevelled surface 89 therebetween. Formed integrally with skirt 60 at the bottom end thereof is a transverse annular inwardly directed retaining flange 90 defined by a curvilinear bottom wall 91 and surfaces 88 and 84. To increase its resiliency, skirt 60 is provided with a plurality of longitudinal slits 92 each extending upward through flange 90 to an intermediate point in the length of the skirt.

Figure 2:
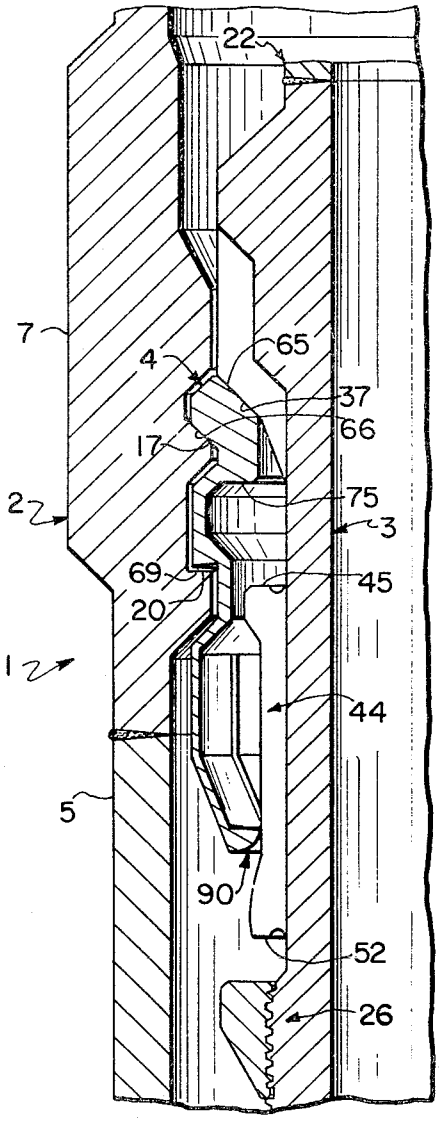
FIG. 2 is a view similar to FIG. 1, showing the apparatus in fully landed condition.

At the upper end of locking ring 4, shoulder 64, upper wall 66 of groove 62, and the portion of surface 61 between shoulder 64 and groove 62 combine to define a transverse annular locking rib 93. Similarly, lower wall 68 of groove 62, upper wall 69 of groove 63 and the portion of surface 61 between walls 68 and 69 combine to define a transverse annular catching rib 94. Ribs 93 and 94 are spaced apart by a distance such that the portion of body 2 defined by surfaces 17, 18 and the portion of surface 12 therebetween can be fully accommodated in groove 62. The axial width of rib 94 is very slightly smaller than the axial width of groove 14. Thus, rib 93 can mate fully with groove 13, and with rib 93 so mated, rib 94 is fully accommodated by groove 14 and shoulder 69 is spaced very slightly above shoulder 20, as seen in FIG. 2.

The distance between inwardly projecting bottom flange 90 on the skirt and downwardly facing lifting surface 75 of locking ring 4 is substantially equal to the distance between surfaces 45 and 52 on the lifting rib 44, as seen in FIG. 1.

Ring 4 is installed on mandrel 3 before the mandrel is rigidly secured, as by welding, to two joints of the inner pipe, installation being accomplished by expanding the split ring and slipping the ring over the lower end of the mandrel, then moving the ring axially until flange 90 is aligned with bottom surface 52 of rib 44 and the lifting surface 75 on the ring is aligned with top surface 45 of the rib. At this point, the ring is allowed to relax so that it fits onto the rib 44, as seen in FIG. 1. Then the guard rib 26 is threaded onto the mandrel. By providing the releasable connection of the guard rib, the ring need only be outwardly expanded to a minimum degree, thereby preventing a significant chance of permanent distortion. When the ring is in its initial position, shown in FIG. 1, and the mandrel is moved downwardly relative to ring 2, the camming surface 84 on the skirt engages camming surface 10 on the hanger body 2.

LOCKING OPERATION

Installation of outer pipe 5 positions outer hanger body 2 at that location from which the inner pipe 21 is to be suspended. As the inner pipe is run in, ring 4 remains in the position on mandrel 3 seen in FIG. 1, being retained by engagement of flange 90 with rib 44. As the intermediate portion 24 of the mandrel enters hanger body 2, surface 84 of the skirt of the locking ring engages the corner presented at the inner periphery of camming surface 10 and surface 12 of body 2. Further downward movement of the inner pipe causes locking ring 4 to be compressed inwardly. Initially, such compression is concentrated in skirt 60, occurring both because of the relatively thin wall of the skirt and because of the provision of slits 92. As downward movement of the inner pipe continues, such compression progresses until all of surface 84 has passed the corner, and the outer cylindrical surface 80 has passed the corner, and the outer cylindrical surface 80 of skirt 60 is now embraced by the inner cylindrical surface 12 of intermediate portion 7 of hanger body 2. At this stage, the corner defined by shoulder 69 and surface 61 can engage surface 10, and main body portion 59 of the ring is also compressed, such compression being allowed by slit 58. Throughout this downward movement, ring 4 remains in its initial axial position relative to mandrel 3.

Continued downward movement of the combination of mandrel 3 and ring 4 causes catching rib 94 to pass downwardly to the location of catching groove 14. It will be noted that, as rib 94 passes upper groove 13, skirt 60 is still embraced by inner surface 12 of portion 7 of body 2, so the ring 4 cannot expand to cause engagement of rib 94 in groove 13. As rib 94 begins to mate with groove 14, the locking rib 93 simultaneously begins to mate with locking groove 13 and, since the locking ring is now resiliently contracted, the ring begins to spring outwardly. Thus, catching rib 94 has begun to enter groove 14 as the ring further descends, and catching shoulder 69 of the ring is now partly overlapped with catching shoulder 20 of the hanger body. As downward movement continues, shoulder 69 engages shoulder 20 and the, e.g., 5° taper of these two shoulders causes the two shoulders to coact to help force ring 4 outwardly until locking rib 93 has mated with locking groove 13.

When shoulder 69 engages shoulder 20, further downward movement of ring 4 is prevented. Mating of the main body portion 59 of ring 4 with hanger body 2 not only allows but positively assures relaxation of ring 4 to substantially its fully relaxed diameter. Accordingly, with downward movement of the ring now prevented by engagement of shoulders 69 and 20, the corner of flange 90, defined by surfaces 88 and 91, is disposed to be engaged by the curvilinear surface 51 of rib 44. Thus, further downward movement of mandrel 3, as lowering of the inner pipe continues, causes flange 90 to ride over surface 51 so that the flange embraces surface 49 of the rib. Continued downward movement of the mandrel causes the load-bearing shoulder 37, at the upper end of recess 25, to engage load-bearing shoulder 65 of the locking ring, forcing shoulder 66 of the locking ring into load-bearing engagement with lower wall 17 of groove 13, as seen in FIG. 2. Since shoulders 37, 65, 66 and 17 are all at 45° to the pipe axis, the total downwardly acting load presented by the inner string of pipe is applied in straight line at right angles to the four parallel surfaces.

The elongated intermediate frusto-conical surface 36 of mandrel 3 serves only to assure final centering of locking ring 4 relative to the mandrel as the load-bearing surfaces come into full engagement. Engagement of the load-bearing surfaces under the heavy downward load applied by the inner pipe string serves to force body portion 59 of the locking ring radially outwardly so that locking rib 93 is forced further into locking groove 13.

Ring 4, with its camming surface 84, its resilient skirt 60 and catching shoulder 69, has the capability of distinguishing groove 14 and the catching shoulder 20 of that groove from other obstructions within outer pipe 5 which are encountered during the trip of the combination of the mandrel and locking ring down pipe 5. The manner in which ring 4 enters the intermediate portion 7 of body 2 and then, in effect ignores presence of groove 13 as rib 94 passes that groove, is typical of the manner in which the locking ring responds to obstructions and ignores the obstructions so far as its catching action is concerned. On the other hand, once catching rib 94 has reached catching groove 14, engagement of shoulder 69 with shoulder 20 positively causes flange 90 to be released from rib 44 and positively causes the locking ring to expand radially to assure full engagement with hanger body 2, as seen in FIG. 2 in which the apparatus is fully landed.

RETRIEVAL OPERATION

Figure 4:
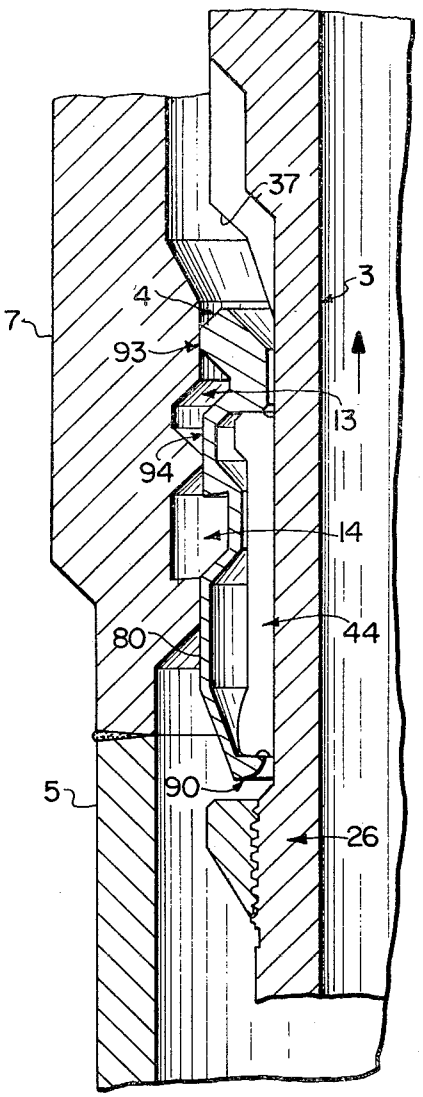
FIGS. 3 and 4 are views similar to FIG. 1 showing the parts in successive positions which occur during retrieval.
Figure 3:
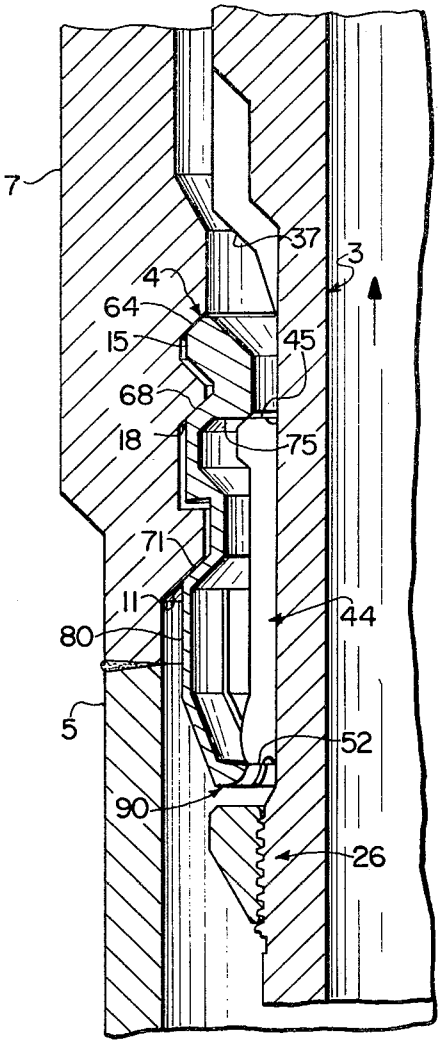

When it is desired to remove the inner pipe string 22, application of an upward strain to that pipe string causes the inner pipe string to move upwardly through the locking ring 4. The inner surface of flange 90 rides on rib 44 from a position shown in FIG. 2 to that shown in FIG. 3 until the bottom surface 52 of rib 44 reaches the position of flange 90 and the flange snaps back along surface 52 and the top lifting surface 45 of rib 44 contacts the lifting surface 75 of ring 4. Continuation of the upward strain on the inner pipe string now urges ring 4 upwardly, causing shoulder 64 on ring 4 to engage shoulder 15 of body 2 and simultaneously causing shoulders 68 and 71 of ring 4 to engage shoulders 18 and 11, respectively, of body 2. Those engaged shoulders now serve to cam ring 4 radially inwardly, such radial compression of the ring being permitted by slit 58. Thus, ribs 93 and 94 of the locking ring are disengaged from grooves 13 and 14 as seen in FIG. 4. Continued upward strain on the inner pipe allows the locking ring to pass upwardly through body 2, the inner pipe string now being free for its return trip to the surface.

Since the rib 44 has the lifting surface 45 engaging the lifting surface 75 on the locking ring 4, a very positive contact is made by the upwardly moving rib and mandrel body against the thick, strong main body portion of the locking ring. This avoids potential damage to the skirt if the upward strain were applied to it instead. This also allows the skirt to be made very thin, thereby increasing its flexibility.

While catching shoulders 20 and 69 advantageously taper at an angle of about 5° relative to planes at right angles to the longitudinal pipe axis, the angle of taper of those shoulders can be in the range of 2° to 10°, smaller angles having a reduced tendency to urge the locking ring outwardly, and larger angles having an increased danger of damage to the corners at the peripheries of the shoulders. While shoulders 37, 65, 66 and 17 are advantageously at 45°, the angle of taper of these shoulders can be 30°–60°, so long as all four shoulders are essentially parallel to each other.

What is claimed is:

1. In a pipe hanger apparatus of the type comprising an outer hanger body having a transverse annular inwardly opening locking groove; a hanger mandrel dimensioned to pass downwardly within the outer hanger body and having an axially elongated transverse annular recess opening outwardly into the annulus between the mandrel and outer hanger body, there being a transverse annular downwardly facing support surface at the upper end of the mandrel recess; and generally annular lock means disposed in the mandrel recess and comprising a heavier main body portion and a thinner, dependent flexible skirt portion, the main body portion having a transverse annular outer locking rib of a configuration to mate with the locking groove of the outer hanger body, the lock means being resiliently deformable radially, the lock means and the outer hanger body having tapered shoulders which coact as camming surfaces to deform the lock means inwardly as the mandrel and lock means is lifted from the outer hanger body, the improvement comprising means on the main body portion of the lock means presenting a downwardly facing lifting surface located inwardly of the skirt portion; and means on the mandrel presenting an upwardly facing lifting surface opposed to the downwardly facing lifting surface of the main body portion of the lock means, movement of the mandrel upwardly relative to the lock means causing the lifting surface of the mandrel to engage the lifting surface of the main body portion of the lock means, whereby after the hanger has landed, an upward strain applied to the pipe string being suspended applies a retrieving force directly to the main body portion of the lock means without applying a significant axially directed force to the dependent skirt.

2. The combination defined in claim 1, wherein said lock means has a lifting groove formed therein, the top wall of said groove being said downwardly facing lifting surface.

3. The combination defined in claim 2, wherein said downwardly facing lifting surface is generally annular and lies in a plane perpendicular to the longitudinal axis of said lock means.

4. The combination defined in claim 3, wherein said lifting groove further comprises an outwardly and downwardly directed frusto-conical surface extending from said downwardly facing lifting surface, a cylindrical surface extending from said outwardly and downwardly directed frusto-conical surface, and an inwardly and downwardly directed frusto-conical surface extending from said cylindrical surface.

5. The combination defined in claim 1, wherein said hanger mandrel has a lifting rib formed thereon, the top surface of said rib being said upwardly facing lifting surface.

6. The combination defined in claim 5, wherein said upwardly facing lifting surface is generally annular and lies in a plane perpendicular to the longitudinal axis of said lock means.

7. The combination defined in claim 6, wherein said lifting rib further comprises an outwardly and downwardly directed frusto-conical surface extending from said upwardly facing lifting surface, a cylindrical surface extending from said outwardly and downwardly directed frusto-conical surface, and an inwardly and downwardly directed frusto-conical surface extending from said cylindrical surface.

8. The combination according to claim 5, wherein said lifting rib further comprises a substantially annular bottom surface, said lock means skirt having an inwardly directed flange receivable on said lifting rib bottom surface.

9. The combination according to claim 8, wherein the axial distance between said downwardly facing lifting surface and said inwardly directed flange is substantially equal to the axial distance between said upwardly facing lifting surface and said lifting rib bottom surface.

10. The combination according to claim 5, wherein said lifting rib has a central recess located between said upwardly facing lifting surface and said bottom surface.

11. The combination according to claim 8, wherein said lifting rib further comprises a curvilinear surface extending upwardly from said bottom surface, an upwardly and inwardly directed frusto-conical surface extending from said curvilinear surface, and a cylindrical surface extending from said upwardly and inwardly directed frusto-conical surface.

12. The combination according to claim 5, wherein said hanger mandrel has at least one vertical slot therein for permitting fluid flow, and said lifting rib has at least one vertical slot therein for permitting fluid flow.

13. The combination according to claim 12, wherein said hanger mandrel vertical slot interrupts said downwardly facing end surface at the upper end of said recess in said hanger mandrel.

14. The combination according to claim 12, wherein said hanger mandrel vertical slot and said lifting rib vertical slot are axially aligned.

15. The combination according to claim 5, and further comprising a guard rib located on said hanger mandrel below said lifting rib, said guard rib extending outwardly from said hanger mandrel a distance greater than the outward extension of said lifting rib.

16. The combination according to claim 15, wherein said guard rib is releasably coupled to said hanger mandrel.

* * * * *